United States Patent [19]

Ciarimboli

[11] 4,111,757

[45] Sep. 5, 1978

[54] SMOKELESS AND NON-RECOVERY TYPE COKE OVEN BATTERY

[75] Inventor: Joseph P. Ciarimboli, Greensburg, Pa.

[73] Assignee: Pennsylvania Coke Technology, Inc., Greensburg, Pa.

[21] Appl. No.: 797,141

[22] Filed: May 25, 1977

[51] Int. Cl.[2] ..... C10B 9/00; C10B 39/18

[52] U.S. Cl. ..... 202/93; 202/102; 202/211; 202/227; 202/263

[58] Field of Search ..... 202/92, 93, 101, 102, 202/113, 114, 211, 212, 227, 263; 201/15, 14, 13, 27, 39

[56] References Cited

U.S. PATENT DOCUMENTS

| | | | |
|---|---|---|---|
| 3,645,854 | 2/1972 | Calderon | 202/263 X |
| 3,716,457 | 2/1973 | Schon | 202/263 |
| 3,844,901 | 10/1974 | Roe et al. | 202/227 X |
| 3,912,597 | 10/1975 | MacDonald et al. | 202/102 |
| 3,930,961 | 1/1976 | Sustarsic et al. | 202/227 |
| 4,045,299 | 8/1977 | MacDonald | 201/27 X |

*Primary Examiner*—Morris O. Wolk
*Assistant Examiner*—Arnold Turk
*Attorney, Agent, or Firm*—Thomas H. Murray

[57] ABSTRACT

Coke from a non-recovery type coke oven is pushed onto a downwardly-inclined floor within a smoke hood joined along one edge of the coke oven. The coke is quenched by water discharge nozzles inside the hood. The coke is discharged through a gate at the bottom edge of the floor onto a conveyor after quenching is completed. The smoke and effluent within the hood pass into the top of two interconnected ignition chambers filled with checkerbrick to incinerate the effluent after which it is drawn from the top of the last ignition chamber into a conduit for discharge by a stack. The ignition chambers include walls isolating the flow spaces for the smoke and quenching fumes from the other flow spaces within checker-filled portions that conduct countercurrently partially-burned distillation products delivered by sole heating flues and downcomers from the space above a coal charge in the coke oven chamber. The ignition chambers are disposed between two coke oven chambers so that the partially-burned distillation products from these coke oven chambers are passed for incineration in the ignition chamber. The space beneath the smoke hood is subdivided by vertical walls forming compartments within the smoke hood each associated with two coke oven chambers and the ignition chambers therefor. Draft changeover valves are closed only when it is desired to draw smoke and the effluent from a chamber under the smoke hood into the ignition chambers.

11 Claims, 4 Drawing Figures

SMOKELESS AND NON-RECOVERY TYPE COKE OVEN BATTERY

BACKGROUND OF THE INVENTION

This invention relates to the production of coke in a non-recovery type coke oven, and more particularly to apparatus for quenching the coke outside the coking chamber and at the same time to incinerate the smoke and effluent from the coke while located outside the coke oven chamber during the quenching process.

Currently, the chief method for producing coke is accomplished by a by-product or retort process wherein air is excluded from the coking chamber and all volatile products liberated during the distillation process are recovered as gas and other coal by-product chemicals. In recent years, coke producers using the by-product process have had difficulty disposing of the recovered coal chemicals on a profitable basis, particularly since many of the same or equivalent chemicals are recovered incident to the refining of petroleum products. The cost of producing coke by the by-product method has increased because the sale of chemicals is now less profitable.

Emissions of smoke and distillation gases unavoidably occur in the retort process. Cracks in the oven masonry, failure of coke oven doors to properly seal the coke oven chamber and the entire period of time while coke is pushed from the oven chamber permit the escape of effluent into the atmosphere. After the coke is pushed from an oven chamber, it is transported by coke quenching cars to a tower where it is quenched with water. Thus, after the coke is pushed and until it is quenched, environmental pollution is a serious problem.

A much older coking process is carried out in a non-recovery type coke oven which is sometimes referred to in the art as a beehive coke oven. A battery of such coke ovens were build adjacent each other and operated by pulling from alternate ovens on alternate days, the masses of coke. The heat from the side walls of the hot coke ovens and any residual heat retained in a newly-charged coke oven was usually sufficient to ignite the coal in the newly-charged coke oven. The cycle for production of coke by each oven chamber was about 72 hours. A non-recovery type coking process provides important features and advantages, particularly a more economical process. The coke ovens are less costly and require a minimum of ancilliary equipment, particularly because facilities are not required for treating by-products of the coking process. However, smoke, together with other unburnt volatile products, escaped during the coking process into the atmosphere. The emissions were a source of environmental pollution whereby the non-recovery type coking process has been largely done away with in view of current environmental standards.

At the end of the coking process, the brickwork used to close an opening in a wall of the non-recovery coke oven is removed and the coke is quenched by moving spray pipes into the oven chamber. After quenching, the coke is drawn from the oven chamber either manually or by suitable machinery for transport to a wharf where it is stored for classification and then shipment. Smoke and other unburnt volatile products during quenching were another source of environmental pollution.

In U.S. Pat. No. 4,045,299, assigned to the same Assignee as the present invention, there is disclosed a smokeless and non-recovery type coke oven wherein the distillation gases liberated during the coking process are conducted from the space above the coal charge downwardly along passageways in the side walls forming the oven chamber into a sole heating flue. Primary air is fed into the oven chamber to maintain combustion within the space above the coal charge. Secondary air is fed into the downcomers for combustion of gases in the sole heating flues and in a tandem arrangement of ignition chambers located downstream therefrom. The ignition chambers are positioned between two such coke ovens to incinerate any unburnt distillation products received from the sole heating flues of the two oven chambers. Additional quantities of secondary air for combustion are injected into the ignition chambers and a burner is used to maintain a predetermined minimum temperature at all times in the ignition chamber to insure incineration of the smoke gases passing therethrough. Waste gases are conducted from the ignition chambers by a horizontal duct to a stack.

In application Ser. No. 788,284, filed Apr. 18, 1977 and assigned to the same Assignee as the present invention, there is disclosed an automatic control for a coking process in a smokeless and non-recovery type coke oven. A negative draft pressure of between 0.15 and 0.17 inch water gage is maintained at all times on each of the two oven chambers while supplies of secondary air fed into the downcomers are progressively decreased so as to maximize combustion of distillation gases in the downcomers and the sole heating flues as well as the ignition chambers. Such a method of operating the non-recovery type coke oven provides an increased coking rate without polluting the atmosphere with effluents including the distillation gases given off from the coal charge in the oven chambers.

SUMMARY OF THE INVENTION

It is an object of the present invention to provide an improved smokeless and non-recovery type coke oven battery embodying a construction and arrangement of parts to incinerate not only the distillation products liberated during the coking process but also the smoke and effluent discharged while the coke is outside the oven chamber and throughout quenching thereof.

It is a further object of the present invention to provide an improved system of ignition chambers each of which is subdivided for the conduction of gases from different sources in a countercurrent manner for the discharge of the harmless incinerated products into the atmosphere through separate conduit and stack members or alternatively through a common conduit and stack system.

It is a further object of the present invention to provide a battery of smokeless and non-recovery type coke ovens wherein coke is discharged from the oven chambers onto a support floor at one side of the oven chambers which floor is adjoined to a smoke hood having baffle walls subdividing the space within the smoke hood into compartments, each compartment is associated with a pair of coke oven chambers between which two serially-connected ignition chambers are subdivided to provide an individual flow path to incinerate smoke and effluent collected within the compartment of the smoke hood.

More particularly, according to the present invention, there is provided a smokeless and non-recovery type coke oven comprising means for forming an oven chamber including side walls, an oven roof carried by the side walls, removable door means to discharge coke from the oven chamber, and a floor to support the coal charge introduced into the oven chamber through a closable opening, means defining a sole heating flue for conducting partially-burned distillation products beneath the floor of the oven chamber, means for conducting partially-burned distillation products from the space above the coal charge in the oven chamber into the sole heating flue, means defining a discharge flue arranged to receive the partially-burned distillation products from the sole heating flue, ignition chamber means including checkerbrick therein to incinerate the partially-burned distillation products received from the discharge flue, burner means including means responsive to the temperature in the ignition chamber means to maintain a predetermined temperature therein, secondary air supply means coupled to the ignition chamber means to insure incineration of the partially-burned distillation products therein, means to draw the incinerated products from the ignition chamber means for discharge into the atmosphere, a ramp at the coke side of the oven chamber to support coke discharged therefrom, a smoke hood including side walls forming an enclosure for the coke on the ramp, water discharge means for cooling the coke on the ramp, and means to feed the effluent liberated during cooling of the coke beneath the smoke hood into the ignition chamber means for incineration.

In the preferred form of the present invention, a battery of coke oven chambers is provided wherein the ignition chamber means extends between the walls of two individual coke oven chambers to incinerate the gases received from the sole heating flues therefor. The smoke hood includes baffle walls to subdivide the space enclosed by the smoke hood into compartments each associated with two coke oven chambers and an ignition chamber to not only incinerate the distillation gases from the two coke oven chambers but also the smoke gases collected in the compartment of the smoke hood. The ignition chambers between each two coke oven chambers include internal walls forming additional ignition chambers to receive only the effluent from the top of the smoke hood for passage along a flow path countercurrent to the flow path of partially-burned distillation products in the ignition chambers. Valve means are used to control flow of gases from the hood through the ignition chambers so that smoke gases are drawn into the ignition chambers which occur only during pushing and quenching of the coke outside the oven chambers.

These features and advantages of the present invention as well as others will be more fully understood when the following description is read in light of the accompanying drawings, in which.

Figure 1:
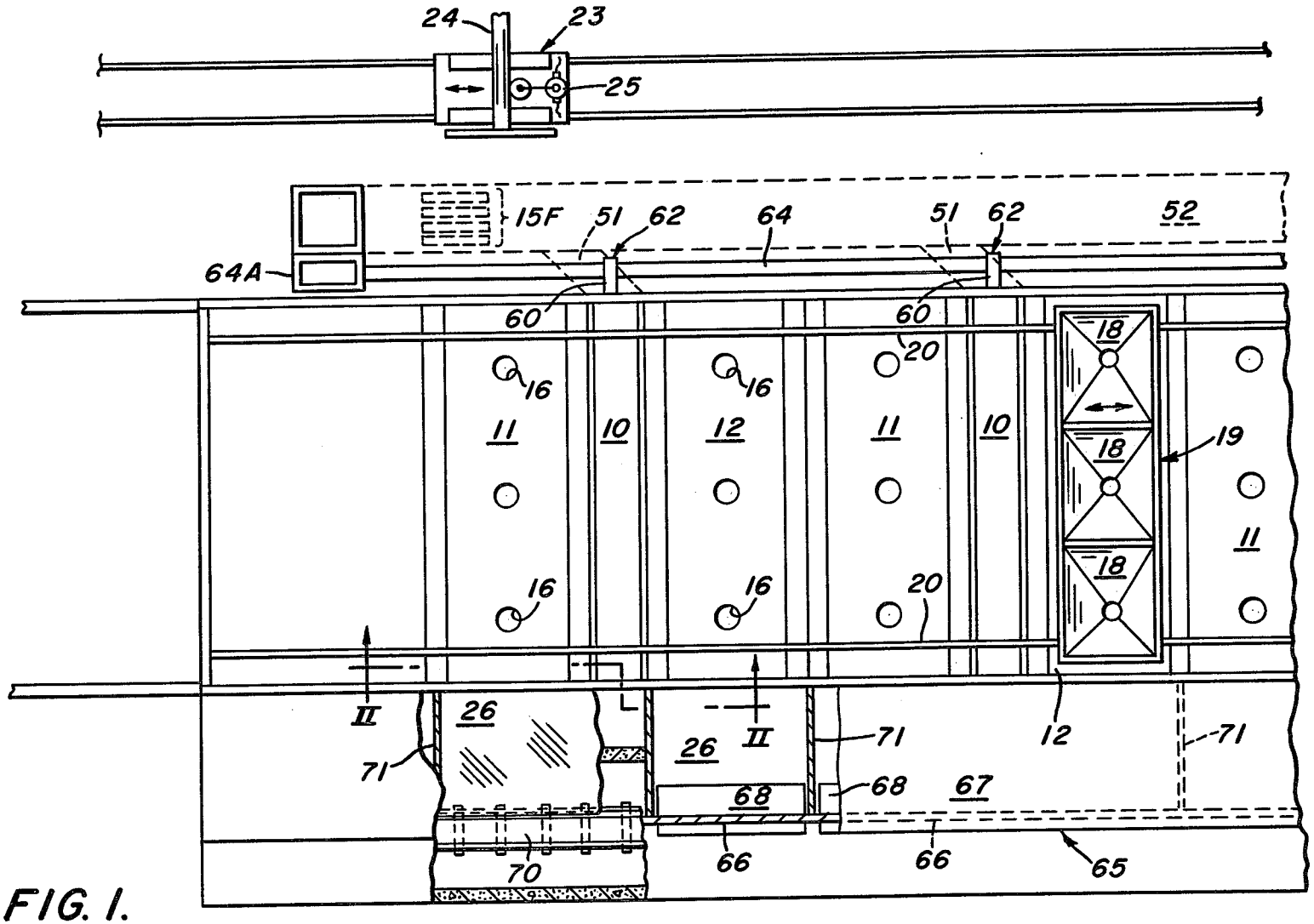
FIG. 1 is an elevational view, partly in section, of a smokeless and non-recovery type coke oven battery embodying the features of the present invention.
Figure 2:
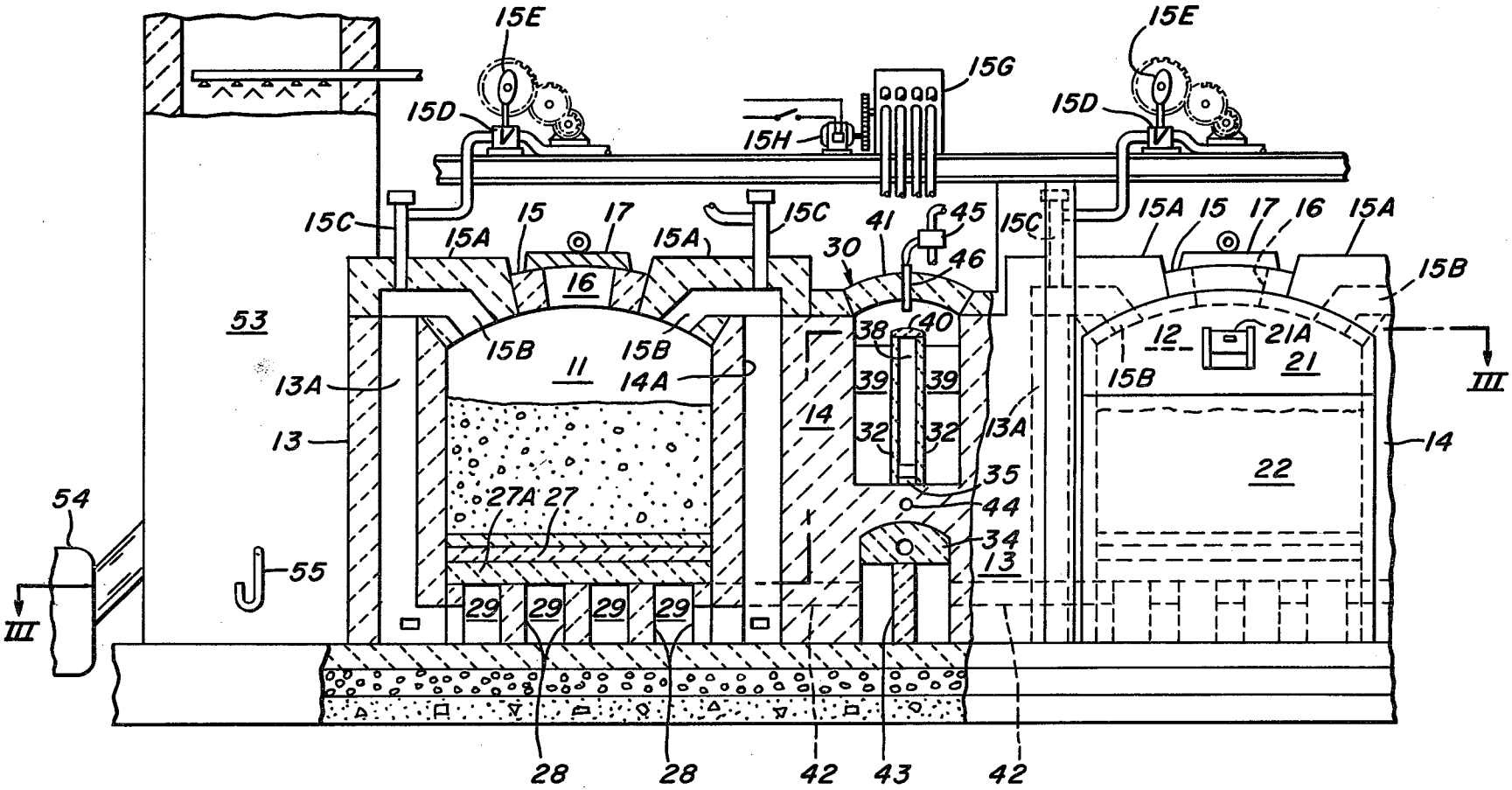
FIG. 2 is an elevational view, partly in section, taken along line II—II of FIG. 1.
Figure 3:
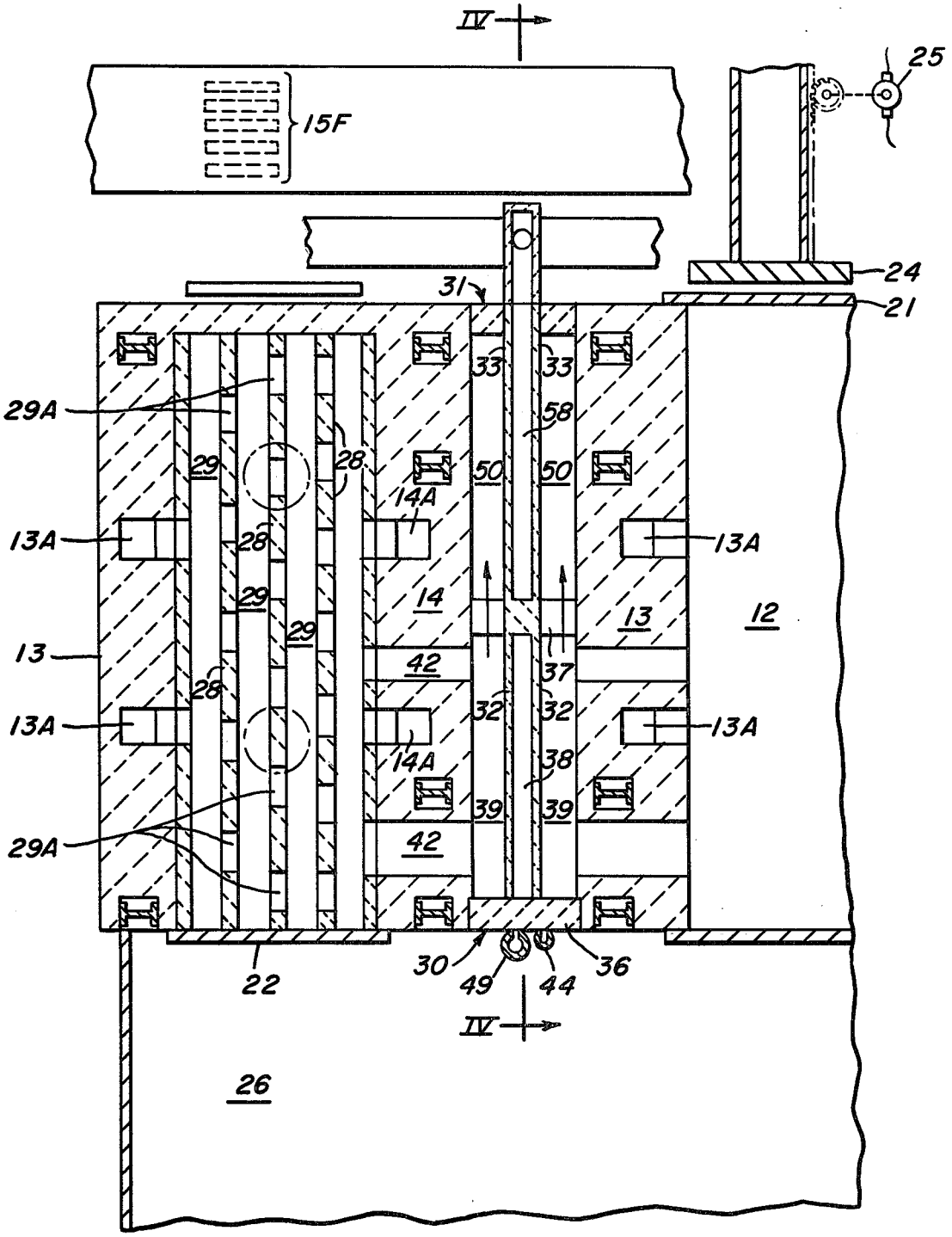
FIG. 3 is a sectional view taken along line III—III of FIG. 2.

In FIG. 1 there is illustrated a smokeless and non-recovery type coke oven battery including a plurality of ignition chamber systems 10 each extending between a pair of coke oven chambers 11 and 12. As shown in FIGS. 2 and 3, the structure defining each coke oven chamber includes upstanding side walls 13 and 14 that are made of refractory brick or the like. An arched roof 15 is carried by the top surface of the side walls and spans the distance between them. Trunnel head openings 16 are formed in the oven roof. While three such trunnel head openings are shown for each coke oven chamber, the number of trunnel head openings is varied depending upon the length of the oven chamber. Each of these openings is normally closed by a removable cover 17 which is removed when coal is charged into the oven chamber from hoppers 18 supported on a larry car 19. The larry car is adapted to move along horizontal rails 20 that are supported by a framework which is, in turn, carried by buckstays used to support the oven masonry.

Upper and lower doors 21 and 22, respectively, close the opposite ends of each of the oven chambers. The upper door at the machine side of each coke oven chamber is removed to permit the use of a leveling bar, not shown, carried on a coke pushing machine 23 to level the charge of coal in the coke oven chamber. The coke pushing machine 23 is movable along the oven chambers at the machine side thereof from chamber-to-chamber so that a pushing ram 24 is brought into alignment with a coke oven chamber. After the upper and lower doors 21 and 22 are removed from both ends of a coking chamber at the end of the coking process, the pusher ram is advanced by a drive motor 25 or the like through the oven chamber, thus pushing the coke from the door opening at the coke side onto a downwardly-inclined floor 26 forming a warf.

As shown in FIG. 2 in regard to the coke oven chamber 12, the upper door 21 includes a slide plate 21A for an opening in the door to adjust the supply of primary air for the coking chamber. Clay or similar material can also be employed to vary the size of a gap provided between the door and the coking chamber to control the supply of primary air at various times throughout the coking process.

As shown in FIGS. 2 and 3, a charge of coal is supported in each oven chamber by a floor 27 that slopes in a downward direction from end-to-end to facilitate removal of the coke. The floor of the oven chamber is preferably made of silicon carbide or other refractory material of high heat conductivity. The floor 27 rests on a bed of silica tile 27A that is, in turn, supported by spaced-apart columns 28 that are arranged parallel to the side walls 13 and 14 to form flue spaces 29 between the columns. The flue spaces 29 are interconnected by a staggered arrangement of openings 29A in the columns. The flue spaces 29 define sole flues used to provide a residence time for combustion and for extraction of residual heat from partially-burned distillation products that are drawn from the space above the coal charge in the oven chambers and flow through downcomers 13A and 14A. These downcomers are passageways formed in the side walls 13 and 14, respectively. FIGS. 2 and 3 illustrate two such downcomers in each of the side walls 13 and 14.

Part of the oven roof is made of sections 15A by using cast refractory material. Formed in these sections are passageways 15B that communicate between the space in the oven chambers above the coal charge and the top of the downcomers 13A and 14A. Each passageway 15B is additionally provided with an opening that extends through the top of the roof section 15A where it communicates in a sealed relation with a vertical pipe 15C. The pipes 15C are employed to introduce heated secondary air for admixture with the partially-burned distillation gases passing downwardly in the downcomers. If desired, the passageways 15B may take the form of openings in the side walls 13 and 14 to conduct distillation gases into the downcomers from the space above the coal charge in the oven chamber. The pipes 15C receive heated secondary air in a line having a valve 15D controlled by a motor-driven cam 15E. The secondary air is heated by a recuperator 15F in a waste-gas conduit, described in greater detail hereinafter. A blower 15G, driven by a motor 15H, feeds air to the recuperator from where the heated air is passed to valves 15D for delivery into the downcomers.

While the features and advantages of the present invention are useful for a single coke oven chamber, it is preferred to arrange the coke oven chambers in a generally side-by-side relation to form a battery of such coke oven chambers. As described previously, lying between the coking chambers 11 and 12 are ignition chamber systems 10 which include interconnected ignition chambers 30 and 31 that extend in an end-to-end relation between the side walls 14 of chamber 11 and the side walls 13 of chamber 12. The side walls 14 and 13 of the oven chambers 11 and 12, respectively, have an added thickness as compared with the thickness of the remaining side walls for the coking chamber 11.

Figure 4:
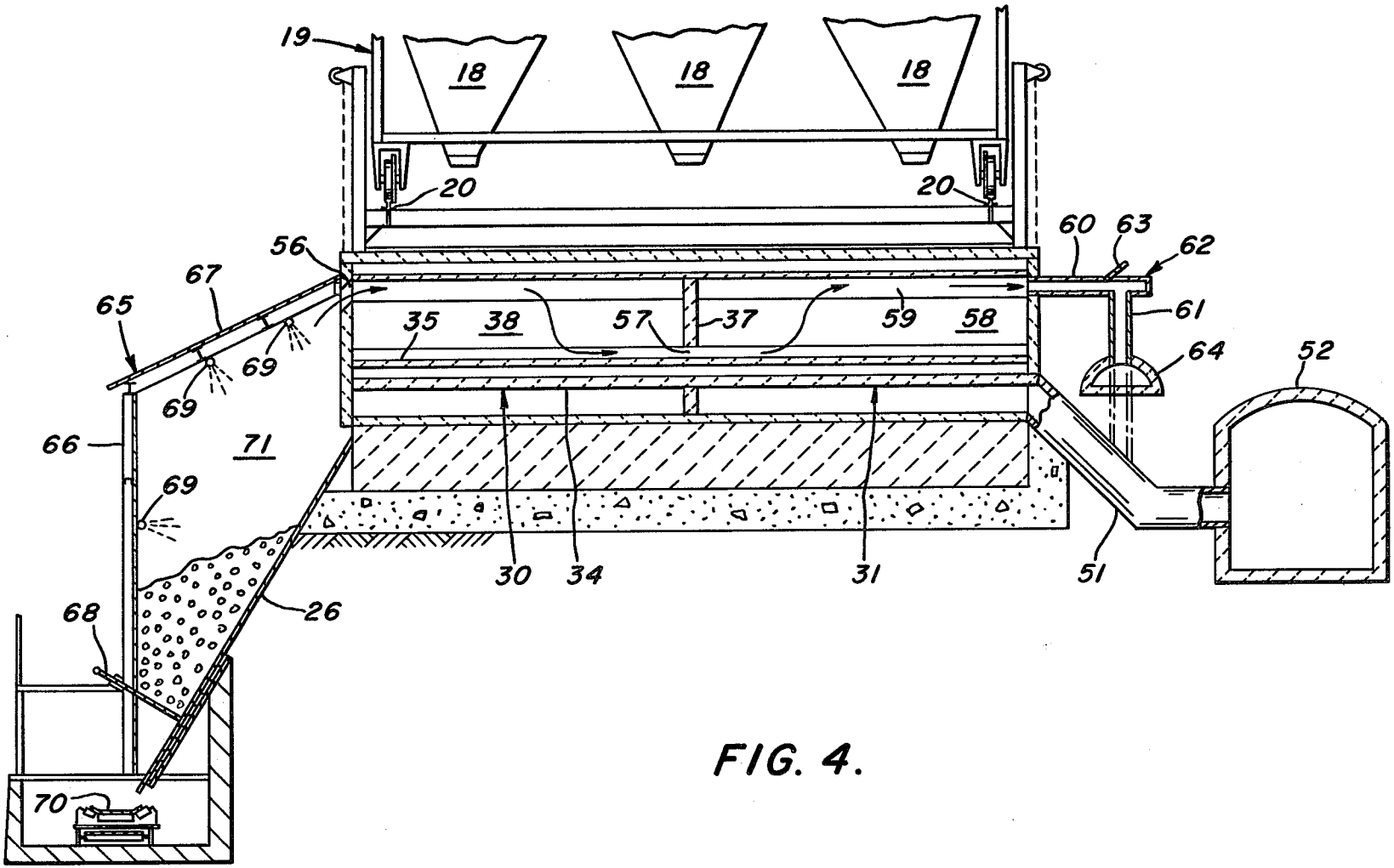
FIG. 4 is a sectional view taken along line IV—IV of FIG. 3.

According to the present invention, as shown in FIGS. 2-4, the ignition chambers 30 and 31 include spaced-apart vertical walls 32 and 33, respectively. These walls rest on rider arches 34 that span the distance between the side walls 13 and 14. A floor wall 35 supported by the rider arch 34 spans the distance between the lower end of walls 32 and extends between a front wall 36 of ignition chamber 30 and a crosswall 37. The space between walls 32 contains a filling of checkerbrick and defines a down-pass secondary ignition chamber 38. Chamber 38 is isolated from up-pass primary ignition chambers 39 at the lateral sides thereof by a cover plate 40 resting on the top edges of walls 32. The space above cover 40 is closed by an arched roof 41 that is located above fillings of checkerbrick in the up-pass primary ignition chambers 39. The arched roof 41 is preferably of the type known as a "bung roof" which includes refractory brick fitted into a cast iron frame so that the roof can be removed for cleaning and replacement of the checkerbricks in chambers 39 as well as in chamber 38 by removing the top plate 40.

Parallel channels 42 in the side walls 13 and 14 of oven chambers 11 and 12, respectively, interconnect the flues 29 and the up-pass primary ignition chambers 39. As shown in FIG. 2, the partially-burned distillation products pass through channels 42 in a generally horizontal direction and enter at opposite sides of a baffle wall 43 from where they pass upwardly to admix in the space located above the top edge of baffle wall 43 and the bottom of the up-pass ignition chambers 39. The baffle wall 43 extends from the front wall 36 to the crosswall 37.

Under preferred operating conditions, the checkerbrick in the up-pass primary ignition chambers 39 will store heat to maintain an elevated temperature in the ignition chambers. Since adverse conditions do arise whereby it is not possible to continuously maintain an operating temperature of, for example, 1600° F. because of a charge of off-grade coal and interruptions for maintenance or other repair operations, a burner 44 is turned ON to supply additional heat during these periods of time. The burner opens out of the front wall 36 to introduce heat into the ignition chambers via the space above the partition wall 43. The burner is turned ON only to insure that the temperature in the ignition chamber does not fall below a predetermined minimum temperature such as 1600° F. to insure incineration of the partially-burned distillation products and smokeless operation of the coke oven whereby the emissions from the stack are essentially only waves of heat. The burner 44 receives a controlled supply of fuel, e.g., oil or natural gas. For this purpose, a controller 45 operates in response to a signal from a thermocouple 46 projecting from the lower surface of roof 41 in a manner to detect the temperature of the gases in the space above the cover plate 40 as these gases pass upwardly from the primary ignition chambers 39. The outer wall 36 includes a further opening coupled to the end of a vertically-extending pipe 49 which has a flow control valve, not shown, to adjustably select a constant volume of heated secondary air. The secondary air is injected below the primary ignition chambers 39 to admix with the partially-burned distillation gases to insure incineration of the gases within the ignition chambers. As shown in FIG. 3, the gases passing from the tops of the ignition chambers 39 flow over the top edge of crosswall 37 into the space above down-pass primary ignition chambers 50 so that the products of combustion are drawn off from the bottoms of the down-pass ignition chambers 50 through a conduit 51 and into a flue-gas collector 52 having a refractory lining. The collector 52 extends along the back of the coke oven battery. The gases conducted by the collector flow beyond the heat recuperator 15F into the base of a stack 53. Means, such as a fan 54, is used to control the flow of gases within the stack by supplying additional quantities of air and thereby control the draft on the coke oven chambers. The draft controls the flow of gases in the downcomers, sole heating flues and ignition chambers. A draft gage 55 may be used as disclosed in the aforementioned application Ser. No. 788,284 to maintain a negative stack pressure within the range of 0.15 to 0.17 inch water gage.

As will be described in greater detail hereinafter, smoke gases and quenching fumes enter through an opening 56 in front wall 36 into the down-pass auxiliary ignition chamber 38. At the bottom of the down-pass auxiliary ignition chamber 38, the gases flow horizontally through an opening 57 in the internal wall 37 where they enter below an up-pass auxiliary ignition chamber 58 containing a filling of checkerbrick in the space between walls 33. The cover plate 40 extends beyond wall 37 along the top edges of walls 33 in sealed communication therewith whereby a horizontal flow space 59 is provided to deliver the incinerated gases to a horizontal pipe 60 coupled to a downwardly-extending pipe 61 by a valve 62. The valve includes an air flap 63 which, when opened, stagnates the flow of gases through auxiliary ignition chambers 38 and 58 and when closed applies a draft to these chambers developed in a horizontal conduit 64 extending along in a generally parallel relation with conduit 52 (FIG. 4) to a second stack 64A. As an alternative to this arrangement of parts, the conduit 64 and stack coupled thereto may be eliminated by extending the conduit 61 into a gasconducting relation with conduit 51 whereby the incinerated gases from the auxiliary ignition chambers are exhausted to the atmosphere by the stack 53.

As described previously, a floor 26 extends downwardly along the coke side of the battery of coke oven chambers. A smoke hood 65 includes an outer vertical wall 66 joined along its upper edge to a roof 67 which extends in an upwardly-inclined manner into a contacting relation with the outer surfaces of the coke oven chambers along their roofs. Thus, it can be seen that the smoke hood encloses the fall space for the coke discharged from the oven chambers. A slide plate 68 forms a barrier to retain the coke within the smoke hood during quenching by water sprays 69. The water sprays are located at spaced-apart locations along the inside surfaces of wall 66 and roof 67. After the coke is quenched, the slide plate 68 is withdrawn either manually or by mechanical means whereby the quenched coke flows into the surface of a conveyor 70 which extends along the battery of coke ovens.

In the preferred form of the present invention, the space enclosed by the smoke hood is subdivided by vertical walls 71 that contact the floor 26, side wall 66, roof 67 and the face surface of the oven masonry. These partition walls are located to form compartments that isolate each pair of coke oven chambers 11 and 12 and the ignition chambers therebetween from a different pair of coke oven chambers and the ignition chambers associated therewith. By employing the baffle plates in this manner, the effluent liberated from the coke when pushed from the oven chamber and the smoke and steam produced during quenching thereof are drawn only into the auxiliary ignition chambers located between one of the two coke oven chambers. This assures that the smoke and effluent are rapidly and efficiently drawn into the ignition chambers for incineration without excessive dilution with air so that sufficient heat is generated during the incineration process to avoid excessive cooling of the ignition chambers. As described previously, the air flap 63 is left open except when coke is pushed and during the quenching process.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a smokeless and non-recovery type coke oven wherein partially-burned distillation products are conducted from the space above a coal charge in an oven chamber into sole heating flues for combustion therein to heat the floor of the oven chamber and thence the partially-burned distillation products are fed from the sole heating flues into checker-filled ignition chambers coupled to an air supply to incinerate the unburned distillation products for discharge by means into the atmosphere, the coke being discharged from the oven chamber through a removable door at the coke side of the coke ovens, the improvement comprising the combination therewith of:

a downwardly-inclined ramp at the coke side of the oven chamber to support coke discharged therefrom, means to discharge a coolant medium for cooling the coke while supported by said ramp, a smoke hood including a roof joined with side walls to form an enclosure overlying said ramp to receive smoke and effluent liberated and rising from the coke on the ramp during cooling of the coke, and means defining a closable passageway to conduct said smoke and effluent from beneath said smoke hood into said checker-filled ignition chambers for incineration of the effluent, the closable passageway including a closure member to interrupt communication with the ignition chambers after cooling of coke on said ramp, the arrangement of parts being such that the smoke from the smoke hood undergoes conversion within the ignition chambers to clean hot air.

2. The smokeless and non-recovery type coke oven according to claim 1 wherein the combination further comprises burner means responsive to the temperature in said checker-filled ignition chambers to maintain a predetermined temperature therein.

3. The smokeless and non-recovery coke oven according to claim 1 wherein said smoke hood is supported along one edge by means forming an oven chamber.

4. The smokless and non-recovery type coke oven according to claim 1 wherein said checker-filled ignition chambers include chamber walls defining individual gas flow spaces to separately incinerate the partially-burned distillation products from said sole heating flues and the smoke and effluent liberated beneath said smoke hood.

5. The smokeless and non-recovery coke oven according to claim 4 wherein said additional ignition chamber means includes checkerbrick therein to incinerate the smoke and effluent received from beneath the smoke hood.

6. The smokless and non-recovery type coke oven according to claim 1 wherein said checker-filled ignition chambers include first and second ignition chambers, the first ignition chamber conducting partially-burned distillation products upwardly to pass horizontally into the second ignition chamber and then downwardly therealong for discharge into the atmosphere, said first and second ignition chambers including internal walls forming respectively first and second additional ignition chambers to receive effluent from beneath said smoke hood into the top of the first additional ignition chamber and along a flow path countercurrent to the flow of partially-burned distillation products in said first and second ignition chambers.

7. The smokeless and non-recovery coke oven according to claim 6 wherein the combination further comprises a conduit coupled to the second additional ignition chamber to discharge incinerated products into the atmosphere.

8. The smokeless and non-recovery coke oven according to claim 7 wherein said closure member includes valve means to control the flow of smoke and effluent through said additional ignition chamber means.

9. The smokeless and non-recovery coke oven according to claim 8 wherein said valve means communicates with said conduit coupled to the second additional ignition chamber means.

10. The smokeless and non-recovery coke oven according to claim 9 wherein said valve means is operatively arranged to interrupt the gas-conducting relation with the second additional ignition chamber means by feeding atmospheric air into said conduit.

11. In a smokeless and non-recovery type battery of coke ovens wherein partially-burned distillation products are conducted from the space above a coal charge in each oven chamber into sole heating flues for combustion therein to heat the floor of the oven chamber and thence the partially-burned distillation products are fed from the sole heating flues into checker-filled systems of ignition chambers coupled to an air supply to incinerate the unburned distillation products for discharge by a means into the atmosphere, the arrangement being such that the sole heating flues of two oven chambers feed partially-burned distillation products into one system of checker-filled ignition chambers, the coke being discharged from each oven chamber through a removable door at the coke side of the coke ovens, the improvement comprising the combination therewith of:

a downwardly-inclined ramp at the coke side of each oven chamber to support coke discharged therefrom, means to discharge a coolant medium for cooling the coke while supported by said ramp, a smoke hood including a roof joined with side walls to form an enclosure overlying said ramp to receive smoke and effluent liberated and rising from the coke on the ramp during cooling of the coke, said smoke hood further including partitioning side walls subdividing the space beneath the roof into compartments with a given number of coke ovens and ignition chambers coupled to pairs of these oven chambers, and means defining a closable passageway to conduct effluent from each chamber beneath said smoke hood into at least one checker-filled ignition chamber for incineration of the effluent, the closable passageway including a closure member to interrupt communication with the ignition chambers after cooling of coke on said ramp, the arrangement of parts being such that the smoke from the smoke hood undergoes conversion within the ignition chamber to clean hot air.

* * * * *